US005984687A

United States Patent [19]

Schwarz

[11] Patent Number: 5,984,687

[45] **Date of Patent: *Nov. 16, 1999**

[54] ROTATABLE ELECTRICAL CONNECTOR

[76] Inventor: Paul E. Schwarz, 4206 Woodland Dr., Post Falls, Id. 83854

[ * ] Notice: This patent issued on a continued prosecution application filed under 37 CFR 1.53(d), and is subject to the twenty year patent term provisions of 35 U.S.C. 154(a)(2).

[21] Appl. No.: 08/909,504

[22] Filed: Aug. 12, 1997

Related U.S. Application Data

[60] Provisional application No. 60/030,330, Nov. 5, 1996.

[51] Int. Cl.[6] ..... H01R 39/00

[52] U.S. Cl. ..... 439/17; 439/24

[58] Field of Search ..... 439/20, 22, 23, 439/24, 25, 26, 18, 17

[56] References Cited

U.S. PATENT DOCUMENTS

| | | | |
|---|---|---|---|
| 1,649,276 | 11/1927 | Adam | 439/17 |
| 1,837,890 | 12/1931 | Baker | 439/8 |
| 1,934,799 | 11/1933 | Gunby | 439/17 |
| 2,520,739 | 8/1950 | Shaw | 439/268 |
| 2,702,376 | 2/1955 | Brush | 439/252 |
| 3,123,421 | 3/1964 | Phillips | 439/17 |
| 3,193,636 | 7/1965 | Daniels | 200/51.12 |
| 3,855,568 | 12/1974 | Cochrane | 439/668 |
| 4,074,924 | 2/1978 | Lebecque | 439/1 |
| 4,143,930 | 3/1979 | Schauer | 439/23 |
| 4,186,987 | 2/1980 | Pearce, Jr. et al. | 439/279 |
| 4,592,605 | 6/1986 | Kapler | 439/17 |
| 4,894,014 | 1/1990 | Palus et al. | 439/17 |
| 5,409,403 | 4/1995 | Falossi et al. | 439/668 |
| 5,425,645 | 6/1995 | Skovdal et al. | 439/23 |
| 5,468,912 | 11/1995 | Zalewski | 439/22 |
| 5,803,750 | 9/1998 | Purington et al. | 439/17 |

FOREIGN PATENT DOCUMENTS 3605-076-A 8/1987 Germany .

*Primary Examiner*—Neil Abrams
*Assistant Examiner*—T C Patel
*Attorney, Agent, or Firm*—Darby & Darby, P.C.

[57] ABSTRACT

A rotatable electrical connector for connection with first and second electrical power cord segments includes a male connector member and a female connector member. The male connector member comprises at least one conductor for connection with respective electric wires in the first power cord segment. The female connector member comprises at least one bearing assembly for connection with respective electric wires of the second power cord segment and sized for engagement with the respective at least one conductor. The bearing assembly is formed of an electrically conductive material to establish electrical communication between the first and second power cord segments.

17 Claims, 2 Drawing Sheets

ROTATABLE ELECTRICAL CONNECTOR

This application claims the benefit of U.S. Provisional Application No. 60/030,330 filed Nov. 5, 1996.

BACKGROUND OF THE INVENTION

1. Field of the Invention

The present invention relates to electrical connectors for power cords and the like. More particularly, the present invention relates to rotatable connectors that freely rotate.

2. Description of the Prior Art

Electrical power cords are used in many different applications to conduct electricity from a power source to an electrically powered apparatus. Power cords are used in connection with all types of electronic equipment such as stereos and computers, portable electric appliances such as those typically found in a kitchen, hand-held power tools and the like. Power cords can be formed having virtually any length, from one foot or less to hundreds of feet. Those longer cords, often referred to as extension cords, allow an apparatus connected to the cord to be more portable, as the use of the device will not be restricted by or limited to the location of the power source. Thus, it will be appreciated that power cords serve a number of useful functions in connection with many different types of devices.

One significant drawback associated with power cords is that such cords often tend to twist or become knotted during use. This problem is especially prevalent in connection with equipment that is continuously moved around relative to the power source, such as typical hand-held power tools. A tangled or twisted cord results in a reduction of the effective length of the power cord, which limits the useful range of the tool coupled to the power cord. This requires that the user manually untangle the cord, which is inconvenient, annoying, and time-consuming.

In addition, continual twisting or knotting of a cord can cause stress or strain on the cord. The conductors housed inside the cord may become crimped or may even break, resulting in a shortened useful life of the power cord.

A number of swivel connector designs have been proposed by others in an attempt to overcome the above-described disadvantages. One of those prior art devices includes a plurality of bearings and interposed insulating washers in a housing. A form of that device is disclosed in U.S. Pat. No. 1,649,276 to Adam. The bearings include inner and outer races connected to electric leads from a pair of severed power cord segments. The ends of the electric leads are sandwiched between the inner races and the adjacent insulating washers to effect an electrical connection with the inner races. It will be appreciated that any relative displacement of the bearings and washers will likely create a short circuit, as the electric leads are not securely connected to those races.

Another rotatable, multiple lead connector found in the prior art includes a receptacle with a conically shaped internal bore to receive a generally frusto-conically shaped plug. A form of this device is disclosed in U.S. Pat. No. 3,193,636 to Daniels. The receptacle includes a plurality of radially inwardly projecting, V-shaped conductive contacts at axially and circumferentially spaced apart locations. Outwardly projecting, conductive contact rings with V-shaped grooves are formed on the periphery of the plug to engage the contacts and make electrical contact while allowing the plug to be rotated relative to the receptacle as the V-shaped tips ride in the V-shaped grooves. Such a device requires a rather elaborate and detailed construction. Furthermore, the device is designed such that the points of electrical contact are rotated relative to each other, which over time may cause a wearing down of one of the components such that electrical contact is lost.

Yet another prior art swivel device includes male and female connectors formed with complementary concave and convex circumferential regions to establish electrical contact and to provide for relative rotation. A form of this device is disclosed in U.S. Pat. No. 5,409,403 to Falossi et al. The concave and convex sections are conductive and electrically connected to electric wires from a pair of power cord segments. Use of this device results in relative rotation between the electrical contacts which over time may cause a wearing down of the contact surfaces and thus an open circuit. In addition, if the concave and convex portions are constructed such that they make a strong engagement to resist disengagement, then relative rotation will likewise be resisted by those portions. If, on the other hand, the concave and convex portions are configured so that relative rotation is not resisted, then the connection between those portions will not be very secure and may result in unwanted separations causing an open circuit. Thus this type of device suffers from a number of design defects.

Accordingly, it will be understood that there continues to be a need for a rotatable electrical connector which is relatively simple to construct and which provides secure electrical connections while permitting free rotation. The present invention completely addresses these needs.

SUMMARY OF THE INVENTION

Briefly, and in general terms, the present invention is directed to a rotatable electrical connector for connection with first and second electrical cord segments, each of which includes one or more electric wires. The rotatable electrical connector comprises a male connector member including at least one conductor connected to the respective electric wires in one of the electrical cord segments. The connector further comprises a female connector member including at least one bearing assembly connected to the respective electric wires in the other electrical cord segment. The at least one bearing assembly includes a central opening sized for engaging the respective conductor to establish electrical communication between the first and second electrical cord segments.

Other features and advantages of the present invention will become apparent from the following detailed description, taken in conjunction with the accompanying drawings which illustrate, by way of example, the features of the present invention.

DETAILED DESCRIPTION OF THE PREFERRED EMBODIMENT

Figure 1:
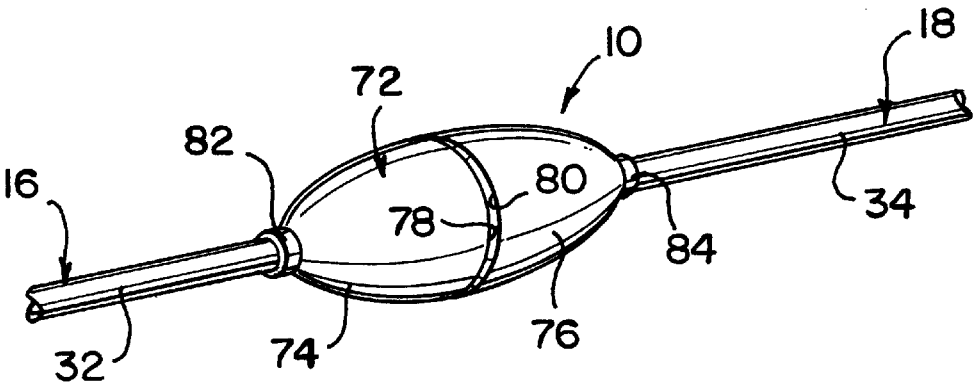
FIG. 1 is a perspective view of a rotatable electrical connector embodying the present invention and connected to electrical power cord segments.
Figure 4:
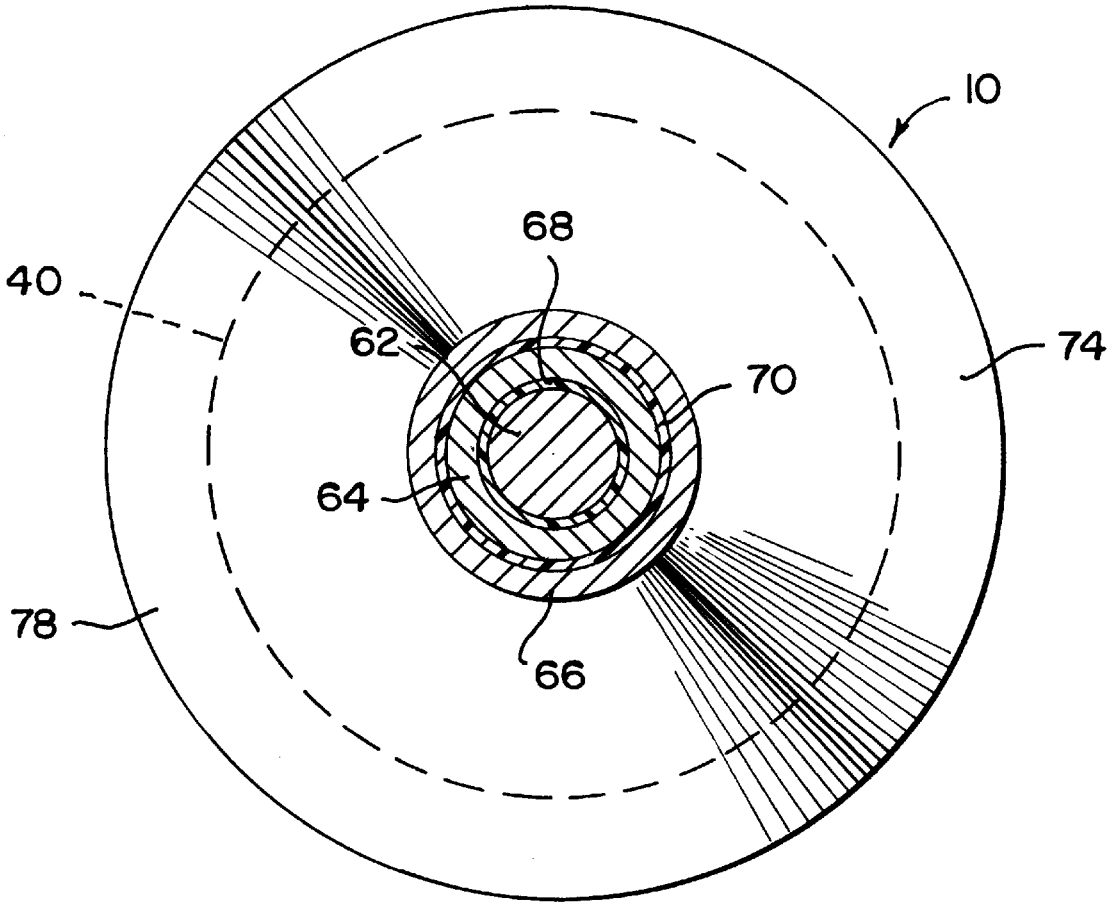
FIG. 4 is a cross-sectional view, in enlarged scale, taken along the line 4—4 of FIG. 3.
Figure 2:
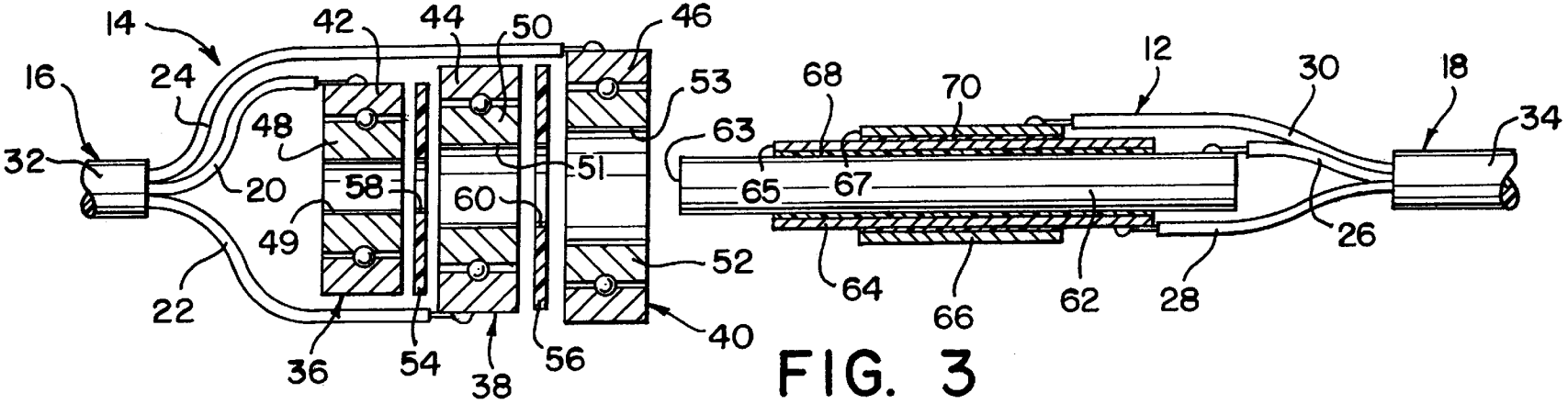
FIG. 2 is an exploded cross-sectional view, in enlarged scale, of the rotatable electrical connector of FIG. 1.
Figure 3:
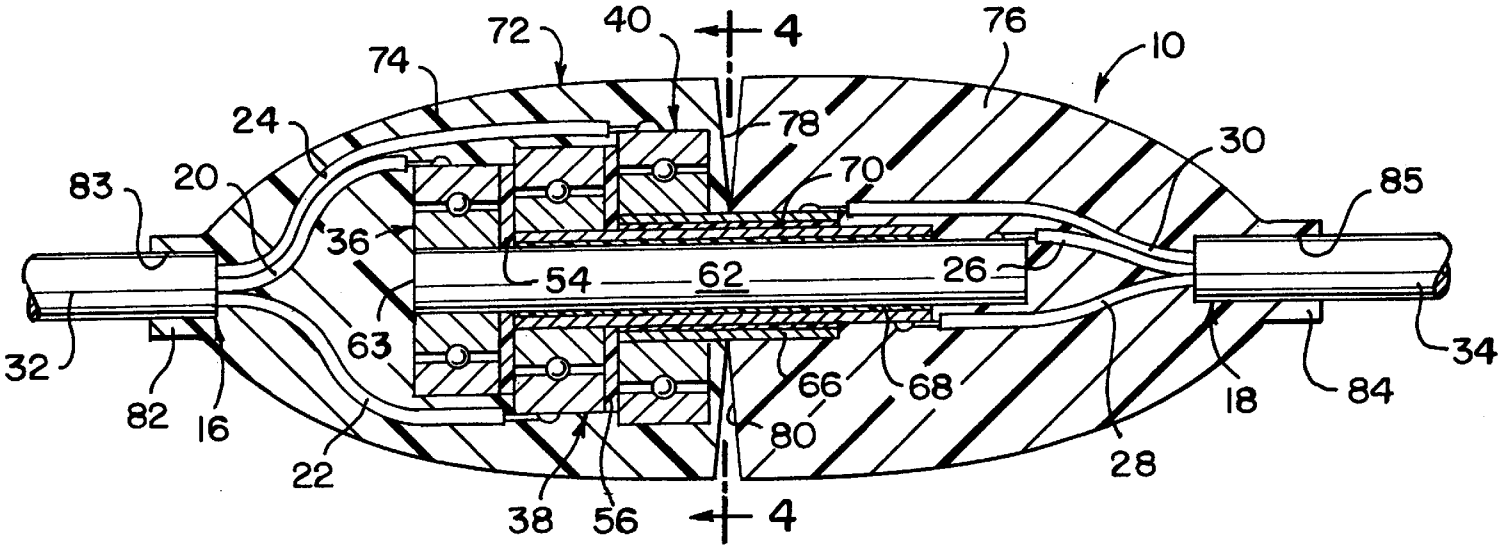
FIG. 3 is a cross-sectional view, in enlarged scale, of the rotatable electrical connector of FIG. 1.

In the following detailed description, like reference numerals will be used to refer to like or corresponding elements in the different figures of the drawings. Referring now to the drawings, and particularly to FIGS. 1, 2, and 3, there is shown, generally, a rotatable electrical connector 10 embodying the present invention. The rotatable electrical connector comprises, generally, a male connector member 12 and a female connector member 14. The connector members are designed to engage a pair of electrical cord segments, generally designated 16 and 18, which include electric wires 20 through 30 encased in protective conduits 32 and 34. The electrical cord segments may lead, respectively, to a plug (not shown) for insertion into a standard electrical outlet and to an electrically powered device (not shown). In another embodiment, one of the electrical cord segments could be housed inside a tool or appliance as described in more detail below. The male and female connector members are detachably engaged to establish electrical communication between the electrical cord segments and to allow for relative rotation.

Referring to FIGS. 2 and 3, the female connector member 14 comprises spaced apart, sealed bearing assemblies, generally designated 36, 38, and 40. In the embodiment shown in the figures merely as an example of one embodiment of the present invention, the female connector member includes three such bearing assemblies. It will be understood that the female connector member could have more or less than three bearings depending upon the number of wires in the cord segments 16 and 18. The number of wires could vary from one wire to virtually any number of wires. The bearing assemblies have different cross-sectional dimensions, with the smallest bearing assembly 36 located closest to the electrical cord segment 16, the middle sized bearing assembly 38 interposed between the other two bearing assemblies, and the largest bearing assembly furthest from the electrical cord segment 16.

Each bearing assembly 36, 38, and 40 includes an electrically conductive outer race 42, 44, and 46 connected to one of the electric wires 20, 22, and 24 of the electrical cord segment 16 by means of soldering or the like. The bearing assemblies are further formed with electrically conductive inner races 48, 50, and 52. The bearing assemblies may be ball bearing assemblies and include electrically conductive balls (not shown) that roll in the channels defined by the inner and outer races. In any event, the bearing assemblies are constructed to conduct electricity from the electric wires, through the outer races, to the respective inner races. The inner races are further formed centrally with cylindrical openings 49, 51, and 53, having varying diameters as described in greater detail below.

While in the preferred embodiment the bearing assemblies 36, 38, and 40 are ball bearing assemblies, it will be understood by those of ordinary skill that many other types of bearing assemblies may instead be used. The bearings could alternatively comprise roller bearings and the like, so long as the bearings allow for relative rotation between the outer and inner races.

Referring to FIGS. 2 and 3, a pair of insulating, non-conductive washers 54 and 56 are provided and are placed between the bearing assemblies 36, 38, and 40 to maintain the bearing assemblies spaced apart and prevent them from coming into contact with each other. The washers are formed centrally with circular openings 58 and 60 of different sizes as described in greater detail below.

Referring to FIGS. 2 and 3, the male connector member 12 comprises three cylindrical conductors 62, 64, and 66. Of course, the number of conductors can differ depending on the number of electric wires in the electrical cord segment 18. The conductors are electrically connected to the electric wires 26, 28, and 30 by means of soldering or the like. The conductors are formed of an electrically conductive material such as metal. In the preferred embodiment, the conductor 62 is a solid, elongated core conductor, but it will be appreciated that it could also be a tubular conductor. The intermediate conductor 64 is tubular and is telescoped over the core conductor. A tubular insulation layer 68 is interposed between the core and intermediate conductors to prevent contact between those conductors. The intermediate conductor has a longitudinal length shorter than that of the core conductor so that the distal end 65 of the intermediate conductor is recessed from the distal end 63 of the core conductor. The outer conductor 66 is likewise tubular, is telescoped over the intermediate conductor and an interposed tubular insulation layer 70, and has a longitudinal length shorter than that of the intermediate conductor such that the distal end 67 of the outer conductor is recessed from the distal end 65 of the intermediate conductor. Thus, the male connector member, when assembled together, has a stepped cross-sectional profile (FIG. 2).

The core conductor 62 has a cross-sectional diameter sized for non-contact extension through the central openings 51 and 53 of the outermost and intermediate bearing assemblies 38 and 40 and for press fitting engagement with the innermost bearing assembly 36. Similarly, the intermediate conductor 64 is sized for non-contact extension through the central opening 53 of the outermost bearing assembly 40 and for press fitting engagement with the intermediate bearing assembly 38. The outer conductor 66 is sized for press fitting engagement with the outermost bearing assembly 40.

While the conductors 62, 64, and 66 are shown and described as being cylindrical, it will be understood that the conductors are not limited to that shape and may have virtually any cross-sectional shape, such as square, rectangular, and the like. In such cases, the inner races 48, 50, and 52 may be formed with complementarily shaped openings for press fitting engagement with those conductors.

In addition, while the conductors 62, 64, and 66 are described herein and shown in the Figures in a telescopic configuration, it will be understood that the conductors may assume different configurations and nevertheless come within the scope of the present invention. For example, the conductors could be embodied in a single tube comprising alternating conductive and insulative segments. The electric wires 26, 28, and 30 could be extended axially through the center of the tube and connected with the conductive segments of the tube. In such an embodiment, the bearing assemblies 36, 38, and 40 would be identical in size. The multi-conductor tube would then be extended through the inner races 48, 50, and 52 until each of the conductive segments registered with one of the inner races to establish electrical communication.

Furthermore, although the rotatable electrical connector 10 is shown and described as being connected to a pair of external cord segments 16 and 18, it will be understood that one of the electrical cord segments could be completely contained inside a power tool or the like (not shown). In that event, either the male or female connector member 12 or 14 could be mounted inside the tool for connection with that electrical cord segment. The tool could be further formed with an inlet opening aligned with the connector member so that the male and female connector members could still be joined together.

Referring to FIGS. 1 and 3, an outer housing, generally designated 72, is provided to encapsulate and shield the male and female connector members 12 and 14. The outer housing is formed of a non-conductive material such as plastic or rubber and comprises first and second housing segments 74 and 76 with angled first ends 78 and 80 that define a V-shaped circumferential gap between the ends (FIG. 3). The respective first ends are so constructed such that if any foreign matter such as dirt or the like lodges in the gap, relative rotation between those ends will cause the foreign matter to be driven outward and out of the gap.

The housing segments 74 and 76 are formed at the opposite ends with cylindrical extensions 82 and 84 including through passageways 83 and 85 sized for telescopic extension of the electrical cord segments 16 and 18 through the respective passageways such that the cord segments make a tight fit in those passageways. The housing protects the respective connector members from being struck and possibly damaged. In addition, the housing provides a smooth, continuous outer surface to prevent the connector from snagging or catching on some external object as the power cord is moved, which otherwise could result in the male and female connector members being pulled apart if the user attempted to free the connector.

Forming the housing segments 74 and 76 with the conical gap may result in moisture contacting the conductor 66. Accordingly, that conductor is preferably connected to the ground wire to eliminate the possibility of electrical shock in the event that moisture does in fact invade the housing. It will be understood that the conductor 66 prevents moisture from contacting the other conductors or the bearings, and therefore acts to shield the rest of the rotatable electrical connector 10 from exposure to water. Therefore, even if the cord segments 16 and 18 are formed with only two wires, the conductor 66 is preferably included to insure that the other conductors are not exposed to such moisture.

Although the housing 72 is shown and described as loosely housing the female and male connector members 12 and 14, it will be appreciated that the outer housing segment 74 could alternatively be formed with a plurality of varyingly sized, spaced apart annular or arcuate seats (not shown) in which the bearing assemblies 62, 64, and 66 would nest. As such, during movement of the power cord, the bearings would maintain a fixed position relative to the outer housing and would not be at risk of being driven against the inner walls of the housing segment. Furthermore, the seats would alleviate the need for the insulating washers, as the bearings would be maintained at spaced locations within the housing segment without risk of the bearings coming into contact with each other.

Thus, from the above description it will be appreciated by those skilled in the art that the rotatable electrical connector 10 of the present invention satisfies a number of existing needs in the art. The connector provides a secure electrical connection between the male connector member 12 and female connector member 14 which resists disconnection. At the same time, the bearing assemblies 36, 38, and 40 allow for relative rotation between the male and female connector members. Thus the connector 10 of the present invention allows the interconnection of the conductors 62, 64, and 66 and bearing assemblies to be as tight as desired, without sacrificing the ease with which the members may rotate relative to each other.

The rotatable electrical connector 10 is preferably manufactured by means of injection molding techniques. Initially, the conductors 62, 64, and 66 are assembled together in telescopic relationship with the insulation layers 68 and 70 interposed between the conductors. The conductors are then press fit into the respective bearing assemblies 36, 38, and 40. The wires 26, 28, and 30 are then soldered onto the respective conductors. The partially assembled connector is then placed into a mold with a fixture clamping the bearing assemblies and conduit 34. The mold is then injected with plastic to form housing segment 76, tubular insulation layers 68 and 70, and the insulating washers 54 and 56. The mold should be constructed so that the insulating washers are not in contact with the outer races of the bearings assemblies, as that would affect rotational movement of the connector. After the connector is removed from the mold, the wires 20, 22, and 24 are soldered to the respective outer races of the bearings. The assembly is then returned to the mold, with the fixture now clamping the housing segment 76 and conduit 32. The mold is again injected with plastic to form housing 74, thereby completing assembly of the connector.

In use, a user may take a finished power cord including the attached rotatable electrical connector 10 and connect one end of the cord with an electrical outlet or other power source. The user may connect the other end of the power cord with an electrically powered device, such as a hand-held power tool. Then, during use of such power tool, if the user rotates or otherwise alters the orientation of the power tool, the connected power cord segment will be twisted accordingly. This results in a corresponding torsional force being applied to the connector member connected to that cord segment. The bearing assemblies allow the male and female connector members to rotate relative to each other, which allows the twisted cord segment to rotate as well, thus preventing the power cord from becoming twisted or knotted, regardless of how the user manipulates the attached power tool.

From the foregoing, it will be appreciated that the rotatable electrical connector 10 of the present invention provides a convenient, reliable device which prevents twisting or knotting of a power cord. The bearing assemblies and coaxial conductors not only cooperate to allow for relative rotation, but also ensure a proper and secure connection to maintain electrical communication between the electrical cord segments.

While several forms of the invention have been described, it will be apparent to those skilled in the art that various modifications and improvements may be made without departing from the spirit and scope of the invention. As such, it is not intended that the invention be limited, except as by the appended claims.

What is claimed is:

1. A rotatable electrical connector for establishing electrical communication between a first electrical cord segment including at least one electric wire and second electrical cord segment including at least one electric wire, the rotatable electrical connector comprising:

a male connector member comprising three conductors of varying dimensions connected to the respective at least one electric wire of the first electrical cord segment; and a female connector member comprising at least three bearing assemblies, each of said bearing assemblies having a different cross-sectional dimension, with the largest bearing assembly being furthest from the electrical cord segment and said largest bearing assembly being a sealed bearing assembly sealing said bearing assembly from outside moisture and debris, wherein said female connector further includes an inner race and an outer race for each of the bearing assemblies, the outer race being connected to the respective at least one electric wire of the second electrical cord segment, wherein the inner race and each conductor establish electrical contact and are sized such that each conductor is press fit into the corresponding inner race to prevent relative rotation between the conductor and the inner race, the press-fit conductors and inner races preventing disassociation of the male connector member from the female connector member when a load is applied to the connector, the bearing assembly being formed of electrically conductive material.

2. The connector of claim 1 further including:

an outer housing for encasing the male and female connector members.

3. The connector of claim 2 wherein:

the outer housing comprises a pair of housing segments, each of which is formed with an interior compartment for housing the respective male and female connector members.

4. The connector of claim 1 wherein:

the at least one bearing assembly includes an outer race for connection with the respective at least one electric wire of the second electrical cord segment, and further includes an inner race having predetermined dimensions for press fitting engagement with the respective at least one conductor.

5. The connector of claim 1 wherein:

the male connector member comprises a plurality of coaxial conductors comprising a cylindrical core conductor and at least one tubular conductor telescopically extended over the core conductor and further including:

at least one tubular insulation layer interposed between the respective conductors, the at least one insulation layer being formed of a substantially nonconductive material, and wherein:

the female connector member comprises a plurality of bearing assemblies for engagement with the respective coaxial conductors.

6. The connector of claim 5 further including:

at least one insulation washer for placement between the respective bearing assemblies, the at least one washer including a central opening for extension of the conductors through the openings.

7. A rotatable electrical connector for connecting a first electrical cord segment including a plurality of electric wires to a second electrical cord segment including a plurality of electrical wires, the rotatable electrical connector comprising:

a male connector member comprising a plurality of coaxial conductors including an elongated core conductor and at least one tubular conductor telescopically extended over the core conductor, the conductors being connected to the respective electric wires of the first electrical cord segment; and a female connector member comprising a plurality of spaced apart bearing assemblies, each bearing assembly having a different cross sectional dimension with the largest bearing assembly being closest to the male connector member and being a sealed bearing assembly sealing said bearing assembly from outside moisture and debris and further including a plurality of inner races and outer races, the respective outer races being connected to the respective electric wires of the second electric cord segment, wherein the inner races and respective coaxial connectors establish electrical contact and are sized such that the respective coaxial conductors are press-fit into the respective inner races to prevent relative rotation between the respective conductors and respective inner races, the press fit conductors and inner races preventing disassociation of the male connector member from the female connector member when a load is applied to the electrical connector, the bearing assemblies being further formed of electrically conductive material, whereby when the conductors are engaged with the respective bearing assemblies, electrical communication is established between the first and second electrical cord segments.

8. The connector of claim 7 further including:

an outer housing encasing the male and female connector members.

9. The connector of claim 8 wherein:

the outer housing comprises a pair of housing segments, each of which is formed with an interior compartment for housing the respective male and female connector members.

10. The connector of claim 7 wherein:

the bearing assemblies include respective outer races connected with the respective electric wires of the second electrical cord segment, and further include inner races having predetermined dimensions for press fitting engagement with the respective coaxial conductors.

11. The connector of claim 7 further including:

a plurality of tubular insulation layers interposed between the respective conductors to prevent contact between the conductors, the insulation layers being formed of a substantially nonconductive material.

12. The connector of claim 7 further including:

a plurality of insulation washers interposed between the respective bearing assemblies, the washers including central openings for extension of the conductors through the openings.

13. An electrical power cord comprising:

a first electrical cord segment including a plurality of electric wires;

a second electrical cord segment including a plurality of electric wires;

a male connector member comprising a plurality of coaxial conductors connected to the respective electric wires of the first electrical cord segment; and a female connector member comprising at least three bearing assemblies, each of said bearing assemblies having a different cross-sectional dimension, with the largest bearing assembly being furthest from the electrical cord segment and said largest bearing assembly being a sealed bearing assembly sealing said bearing assemblies from outside moisture and debris, each bearing assembly including an inner race and an outer race, the respective outer races being electrically connected to the respective electric wires of the second electrical cord segment, wherein each inner race and each conductor establish electrical contact and are respectively sized such that the respective coaxial conductors are press-fit into the respective inner races to prevent relative rotation between the respective conductors and the respective inner races and to prevent disassociation of the male connector and the female connector when a load is applied to the electrical connector, the bearing assemblies being formed of electrically conductive material, whereby when the conductors are engaged with the respective bearing assemblies, electrical communication is established between the first and second electrical core segments.

14. The electrical power cord of claim 13 further including:

an outer housing encasing the male and female connector members.

15. The electrical power cord of claim 13 wherein:

the bearing assemblies include outer races connected with the respective electric wires of the second electrical cord segment, and further include inner races formed with central openings sized for press fitting engagement with the respective coaxial conductors.

16. The electrical power cord of claim 13 wherein:

the coaxial conductors comprise a cylindrical core conductor and a plurality of tubular conductors telescopically extended over the core conductor and further including:

a plurality of tubular insulation layers interposed between the respective conductors to prevent contact between the conductors, the insulation layers being formed of a substantially nonconductive material.

17. The electrical power cord of claim 13 further including:

a plurality of insulation washers interposed between the respective bearing assemblies, the washers including central openings for extension of the conductors through the openings.

* * * * *